US005375498A

United States Patent [19]

Obuchi

[11] Patent Number: 5,375,498

[45] Date of Patent: Dec. 27, 1994

[54] RECORDER

[75] Inventor: Koichi Obuchi, Omiya, Japan

[73] Assignee: Toyama Musical Instrument Co. Ltd., Tokyo, Japan

[21] Appl. No.: 62,076

[22] Filed: May 14, 1993

[30] Foreign Application Priority Data

May 18, 1992 [JP] Japan ..... 4-39465

[51] Int. Cl.[5] ..... G10D 7/00

[52] U.S. Cl. ..... 84/380 R; 84/382

[58] Field of Search ..... 84/380 R, 381, 382, 84/380 A, 380 B, 380 C; 181/192; 116/137 R, 142 R; 446/408

[56] References Cited

U.S. PATENT DOCUMENTS

| | | | |
|---|---|---|---|
| 1,993,714 | 3/1935 | Greenleaf | 84/380 R |
| 3,745,871 | 7/1973 | Diez | 84/380 R |
| 3,972,385 | 8/1976 | Hino et al. | 181/192 |
| 4,515,060 | 5/1985 | Ferron | 84/380 R |

*Primary Examiner*—Michael L. Gellner
*Assistant Examiner*—Cassandra Spyrou
*Attorney, Agent, or Firm*—Frishauf, Holtz, Goodman & Woodward

[57] ABSTRACT

The bore of a recorder opens at a location slightly short of the lowermost end portions of a bell section at the end of the foot joint of the recorder. A concave dent is formed that gradually expands outwardly from the end of a bore opening toward an outer periphery of the bell portion. The concave dent formed at the lower end of the bell portion enables a smooth flow of the air discharged from the end of the bore opening. This bell structure also helps the air which is sucked back into the bore as the reaction to the air being discharged, to be smoothly returned toward the end of the bore opening. As a result, even beginners and small children can easily create the bass tones which otherwise would require complicated manipulations.

6 Claims, 3 Drawing Sheets

RECORDER

BACKGROUND OF THE INVENTION AND RELATED ART STATEMENT

The present invention relates to an improvement of recorder, a musical instrument, and more particularly to an improvement in shape at the tip of its foot joint to make it easier for the player to make the lower-pitched sounds.

Recorders have long been known as a relatively popular and handy instrument for teaching music to school children. Originally, recorders were curved out from wood, but presently they are predominantly molded from synthetic resins in mass production.

As shown in FIG. 6, a recorder usually comprises three tubular members that are integrally connected, i.e. a head joint 10 with a mouth piece 11 at the top into which a player breathes and a window 12, a middle joint 13 with a plurality of tone holes 14, and a foot joint 15 with a bell section 16. An elegantly curved bulge 17 connects the head joint 10 and the middle joint 13. A portion 18 with a slightly larger diameter connects the middle joint 13 and the foot joint 15, which further continues into the bell section 16 with a gradually expanding outer diameter. The recorder as a whole has an elegant and refined shape.

The recorder shape has remained basically the same since the Baroque Period when its functions as a musical instrument were completed and established. Recorders for professional players and for school children are essentially the same in their shape. While the recorder still serves the professionals and adult music lovers, it came to be widely used in the music education of the younger generations thanks, for one, to mass production using synthetic resins which drastically lowered the price. Another reason is that the shape and the size of a recorder are particularly suited to children and easier to handle compared with other musical instruments.

The basic form of a recorder is completed as a result of trials and errors and experiences from the old days, and is essentially tailored to the highly skilled professionals and adult music lovers. In fact, it requires an outstanding artistic skill to fully exploit the intrinsic quality and beauty of a recorder.

Yet, as mentioned earlier, recorders are quite popular among the beginners and school children whose skills are undeveloped. Since the instrument is not, strictly speaking, designed to accommodate unskilled players, it may be quite difficult for them to make certain sounds.

One of the difficulties encountered by a beginner or a child in learning to play a conventional recorder is that it is extremely difficult to make the bass sounds. For the beginners and small children, it is very difficult to make such sounds with sufficient volume or to control their breathings. They are obliged to repeat strenuous drillings and are irritated to eventually give up the practice entirely.

The present inventor studied the problems of the conventional recorder and found that the shape of the foot joint is responsible for the difficulty in making the bass sounds, and therefore succeeded in overcoming the problem by improving the shape of the foot joint at its tip.

As is well known with the traditional recorder, a bore 19 extends from the top of the middle joint 13 toward the lower end of the foot joint 15 with the inner diameter gradually decreasing. The lower end of the bore 19 opens into the center of the bell section 16 formed at the bottom of the foot joint 15. The bottom face of the bell section 16 is either perpendicular to the axis of the bore 19, or may be formed as a curved surface 20 which gently projects outwardly as shown in FIGS. 7 and 8.

The flat or curved surface at the bottom of the bell section of the foot joint is so formed based on empirical findings and experiences of skilled players who found the shape to be effective in making good bass sounds. Whereas the flat or curved surface poses no problem to the skilled players, beginners and children find it highly difficult to play and are obliged to spend a considerable time to master the technique. For example, when a beginner or a child plays the recorder, particularly when he/she tries to make bass sounds, he/she must concentrate on closing the tone holes with his/her fingers while controlling his/her breathings at the same time. If the control of breathings and finger manipulation is not adequate, the volume of the bass sounds emitted becomes inevitably small.

Such a phenomenon shall now be explained in the light of mechanism which is responsible for making sounds with the recorder.

As the air breathed into the windway from the mouthpiece hits the window, the air climbs up the slope provided adjacent to the edge of the window and is discharged into the atmosphere, and a rapid flow of the air thus generated lowers the pressure below the pressure inside the bore. As a result, a certain amount of the air inside the bore is drawn out into the atmosphere through the window. As this occurs, the pressure inside the bore becomes still lowered, causing the air to flow into the bore from the window and the open end of the foot joint.

Because of the action of the edge at the window, the air comes in/out of the window, causing the air density inside the bore to become high/low. In other words, the window acts as a pump to breath in/out the air in the bore. As a result, the air coming inside from the window successively presses the air inside the bore toward the foot joint, where the air in the vicinity of its open end is pushed out into the atmosphere. On the other hand, the air escaping from the window draws the air inside the bore out, to thereby draw in the air near the open end of the foot joint farther into the bore.

The recorder emits its sounds as the air flow caused by the action of the window at the head joint runs back and forth between the window and the open end of the foot joint, forming a stationary wave of a given waveform. If the amplitude of the stationary wave or the air pressure is large, the volume of the sound emitted becomes large, and vice versa. When a stationary wave is generated inside the bore, a pair of anti-nodes are respectively formed at the window and the end of bore opening in foot joint while the nodes are formed at the center.

The timing with which the air flows in/out of the window is such that even if the air flows into the bore from the window, the air at the opening of the foot joint is not instantly pressed outside; rather, there is a time lag as the air which is elastic is forced to flow down inside the narrow bore. Actually, when the air is pressed outside from the opening of the foot joint, next outflow of the air is already caused at the window by said action of the edge, with the air going out. Thus, there occurs a simultaneous inflow of the air at both ends of the bore, which is instantly followed by a simultaneous outflow.

The inflows from both ends of the bore collide with each other at the middle section, and the inflow from the foot joint is discharged from the window and that from the window discharged from the opening of the foot joint respectively. As the flows of air collide with each other at the middle section of the bore, a pressure is generated at the node. The pressure at the node rises when the air flows collide and lowers when they are discharged outside from both ends of the bore.

The difference in the pressure that fluctuates at the node is caused depending on the amount of air flowing into the bore from the window and the opening of the foot joint.

When the amount of air flowing inside and outside the bore from its both ends is large, a relatively high pressure is generated at the node as the flows of air collide with each other inside the bore. However, as the the air flows with high pressures pass in opposite directions, the pressure at the node becomes extremely low. In other words, the difference in the pressure before and after the collision is large. In this case, as the air flows run in the opposite directions toward the window and the foot joint opening respectively after the collision, the pressure at the node lowers significantly, and the amount of inflows from the window and the foot joint respectively toward the node increases to thereby increase the volume of resultant sounds.

On the other hand, if the amount of inflows is small, the pressure generated at the node where the inflows of air collide with each other does not amount to much. As the collided air flows with relatively low pressures run in opposite directions, the pressure at the node does not decrease greatly, resulting in a relatively small pressure difference. In this case, when the air is respectively discharged into the atmosphere from the window and the foot joint opening after the collision, the pressure at the node remains still relatively high, so that the amount of inflows from the window and the foot joint opening toward the node at the middle section is relatively small and the resultant sounds emitted are small in volume.

As was discussed above, beginners and children are not good at breathing the air into the recorder when making bass sounds, and cannot increase the pressure generated at the node, and the amount of air flowing out from the window and the foot joint opening decreases. This in turn decreases the amount of air flowing into the bore, to thereby lower the volume of sound.

At the foot joint 15 of the conventional recorder, the bottom of the bell section 16 is either flat or curved outwardly into a convex plane 20, as shown in FIGS. 7 and 8. As shown also in FIG. 7, a portion of the air flowing along the inner peripheral wall of the bore as it is discharged from the opening 21 at the end of the bore 19 into the atmosphere abruptly loses its directionality at the opening 21 where the bore ends, and adheres to the convex surface 20 as it whirls. When the air flow turns into a whirl along the convex surface 20, turbulence is generated in the air flow coming from the center of the opening 21, preventing smooth discharge of the air.

As a reaction to the air discharge from the opening 21 of the bore 19, the air is drawn inside from the opening 21 as shown in FIG. 8. As the air is drawn in, a portion of the air flow hits the mouth of the opening 21 instead of being smoothly drawn inside from the opening 21. Rather, there occurs a flow in the direction of the outer periphery of the bell section 16 along the convex surface 20, resulting in a significant decrease in the amount of air flowing into the opening 21.

The foot joint of the conventional recorder acts to give resistance to the air flowing out from the center of the opening 21, preventing smooth discharge of the air or significantly decreasing the amount of air flowing into the opening 21. When a beginner or a child who is incapable of dexterously controlling the breathings for making bass sounds plays the recorder of this type, he/she fails to make sufficiently loud sounds due to the inadequate shape at the foot joint as shown in FIGS. 6 and 7.

SUMMARY OF THE INVENTION

An object of the present invention is to provide a recorder which obviates the problem encountered in the prior art and which enables even beginners and children, not to mention skilled players or advanced learners, to emit the bass sounds easily and allows them to practice more efficiently than with the conventional recorder.

As a specific means to achieve the object, the present invention recorder is characterized in that the opening of the bore ends at a location slightly short of the peripheral edge of the bell portion, and there is formed a concave dent on the peripheral wall of the latter at the mouth.

The concave dent at the mouth of the bell section is such that the sloped face thereof curves toward the peripheral wall of the tube like a dome. The sloped face may bulge toward the center of the bore. Alternatively still, the sloped face may be flat without curve, forming a conical dent.

Because the concave dent formed at the bell section at its mouth gradually expands outwardly toward the outer periphery of the bell section, the air discharged from said opening is more easily guided back into the bore through the peripheral edge of the mouth along the concave dent. This enables returning of most of the air discharged smoothly back into the bore without loss, resulting in an increased volume of the sounds.

BRIEF DESCRIPTION OF THE DRAWINGS

Other objects and advantages of this invention will become apparent when taken in conjunction with description herebelow of some embodiments shown in the accompanying drawings.

DETAILED DESCRIPTION OF PREFERRED EMBODIMENTS

Figure 1:
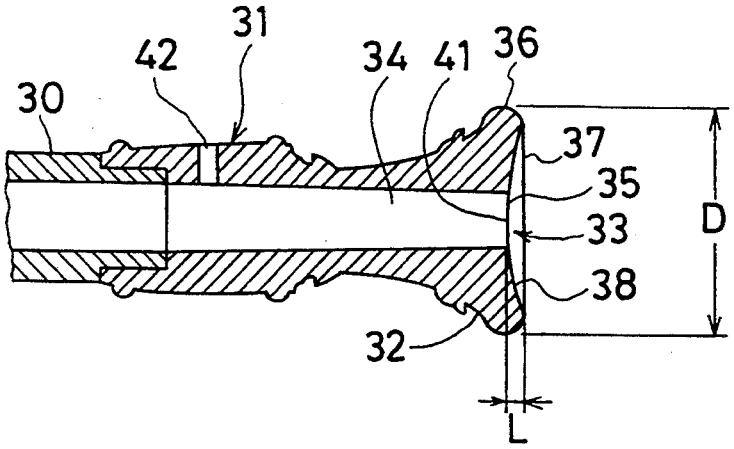
FIG. 1 is a sectional view to show the construction of the foot joint of the recorder according to the first embodiment of the present invention.

Preferred embodiments of the recorder according to the present invention will now be described referring to the accompanying drawings.

The present invention recorder is characterized in that a concave dent 33 is formed at the mouth of the bell section 32 in the foot joint 31 that connects with the middle joint 30.

The end of the bore 34 opens at the center of the mouth of the bell section 32. The opening 35 of the bore ends at a location slightly short of the bottom face 37 which is the lowermost outer peripheral edge 36 of the bell section 32. There is provided a concave dent 33 that gradually expands outwardly from the opening 35 toward the outer peripheral edge 36 of the bell section 32. The reference number 42 denotes a tone hole.

Figure 2:
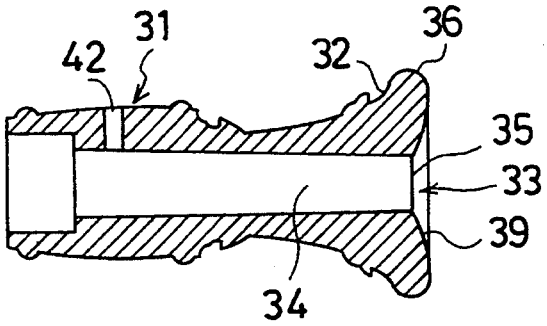
FIG. 2 is a sectional view to show the construction of the foot joint according to the second embodiment.
Figure 3:
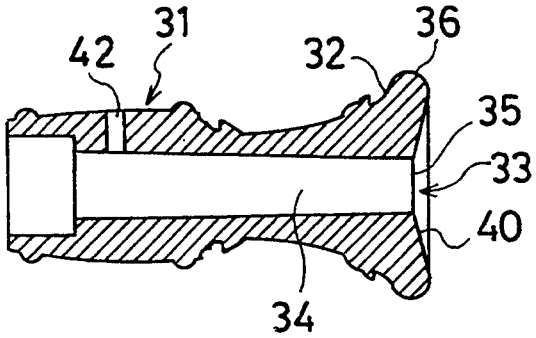
FIG. 3 is a sectional view to show the construction of the foot joint according to the third embodiment.

As shown in FIG. 1, the concave dent 33 is preferably such that its sloped face forms a curved face 38 dented toward the peripheral wall of the bell section 32 like a dome. As shown in FIG. 2, said sloped face forming the concave dent 33 may be a face 39 that bulges toward the center of the bell section 32. Further as shown in FIG. 3, said sloped face forming the concave dent 33 may be a flat conical face 40 that connects the opening 35 and the outer peripheral edge 36 of the bell section 32.

The depth of the concave dent 33 as measured in terms of the length L between the lowermost flat end of the bell section 36 and the mouth of the opening 35 is preferably within 20% of the diameter of the bell section 36 at its outermost circumference. If the depth exceeds said value, the natural tone color of a recorder will be lost. In FIGS. 1 through 3, the peripheral edge portion 41 where the mouth of the opening 35 intersects the concave dent 33 is expressed as an angular line without curving. However, this portion 41 is preferably rounded with a small curvature. If the curvature of the edge 41 is too large, it would be substantially the same as when the depth of the concave dent 33 is increased and is therefore not preferable.

Figure 4:
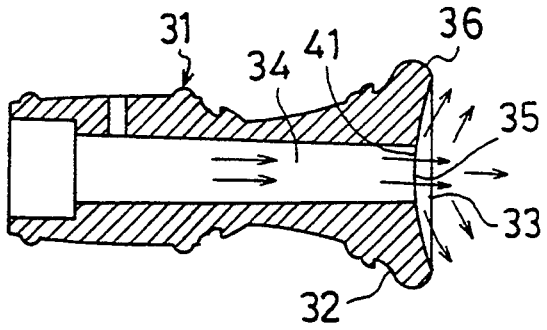
FIG. 4 is a sectional view to show the foot joint of the present invention recorder when the air is discharged from the bore.

As shown in FIG. 4, when the air in the foot joint 31 of the recorder is discharged into the atmosphere from the end of the opening 35, the air escaping from the peripheral edge 41 of the opening 35 will flow along the sloped face of the concave dent 33 that inclines from the opening 35 toward the outer periphery 36 of the bell section, the air flow without abruptly losing its direction of the flow. As a result, the air flows smoothly along the sloped face of the concave dent 33 without causing vortex and is smoothly discharged into the atmosphere from the opening 35.

Figure 5:
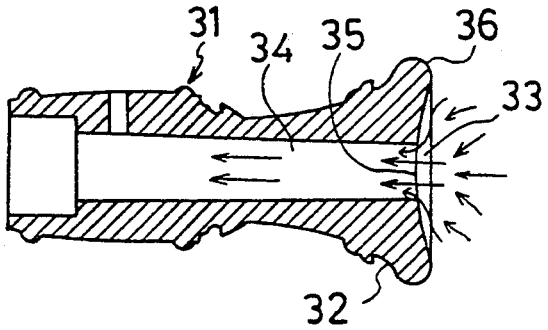
FIG. 5 is another sectional view to show the foot joint when the air is introduced into the bore.
Figure 7:
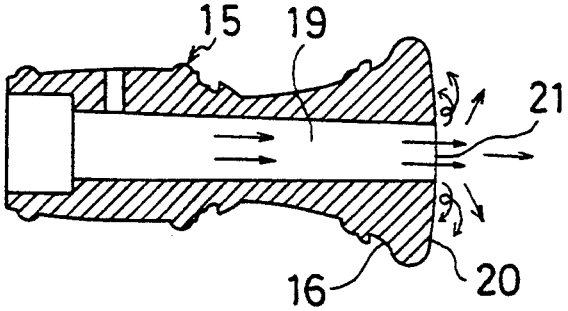
FIG. 7 (PRIOR ART)
FIG. 7 is a side view of the prior art recorder when the air is discharged from the bore of the foot joint.
Figure 8:
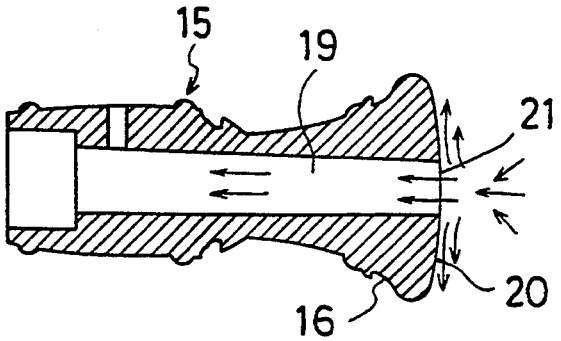
FIG. 8 (PRIOR ART)
FIG. 8 is a side view to show the prior art recorder when the air is introduced inside the bore of the foot joint.
Figure 6:
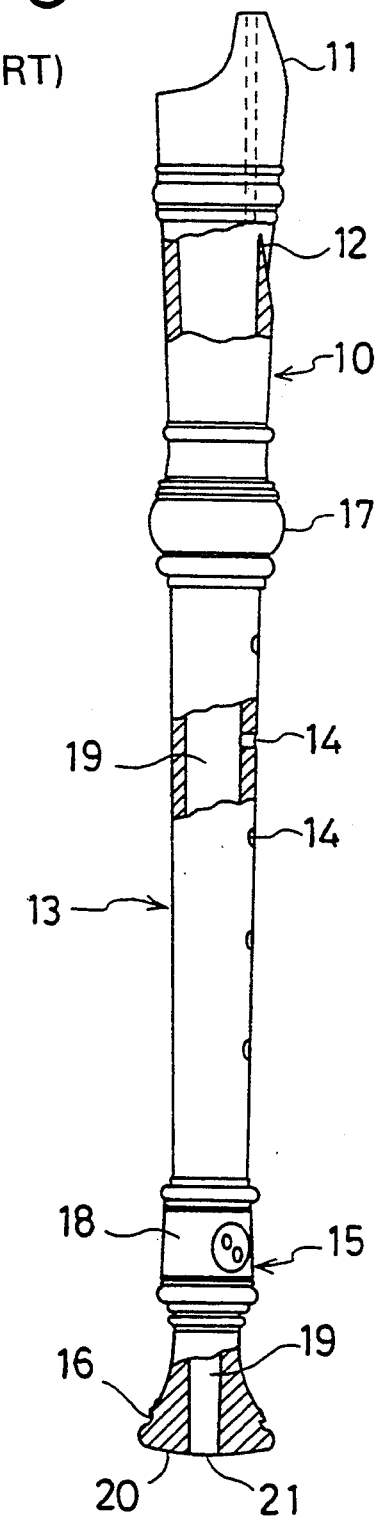
FIG. 6 (PRIOR ART)
FIG. 6 is a side view to show the overall shape of the prior art recorder.

When the air is sucked inside from the opening 35, as shown in FIG. 5, as a reaction to the movement of the air going out from the opening 35 into the atmosphere, the air that hits the surface of the bell section 32 forming the concave dent 33 as well as that hitting the peripheral edge of the opening 35 can be smoothly guided toward the opening 35, enabling almost all of the air discharged from the bore 34 to be returned inside from the opening 35 without loss. This in turn means that the resultant bass tones emitted will have sufficient volume.

By using the present invention recorder having the foot joint of the above construction, beginners and small children can easily make the bass sounds without much trouble in breath controls and therefore can enjoy practicing the recorder.

What is claimed is:

1. A recorder comprising:

a footjoint having a first end and a second end;

a bore extending through said footjoint from said first end to a position slightly short of said second end;

said footjoint further including a bell section extending from said position slightly short of said second end to said second end and defining an outer surface thereof, said bell section having a diameter at said second end; and a concave dent in said bell section, said concave dent gradually increasing in diameter from said position slightly short of said second end to said second end, thereby defining an inner sloped surface having a maximum depth;

said maximum depth of said sloped surface of said concave dent being within 20% of said diameter of said bell section at said second end;

and wherein said inner sloped surface of said concave dent and said outer surface of said bell section define a thick wall section.

2. The recorder of claim 1, wherein:

said inner sloped surface of said concave dent is curved toward an inner peripheral wall of said bore of said bell section.

3. The recorder of claim 2, wherein said inner sloped surface is shaped like a dome.

4. The recorder of claim 1 wherein:

said inner sloped surface of said concave dent bulges outwardly from said bell section.

5. The recorder of claim 1, wherein said inner sloped surface of said concave dent includes a straight line portion connecting said position of said bore which is slightly short of said second end with said outer surface of said bell section.

6. The recorder of claim 5, wherein said inner sloped surface of said concave dent has a cone shape.

* * * * *